US006256791B1

(12) United States Patent
Callahan

(10) Patent No.: US 6,256,791 B1
(45) Date of Patent: Jul. 10, 2001

(54) PHOTOGRAPHER'S VEST WITH BUILT-IN SEATING AND WEIGHT BEARING STRUCTURES

(76) Inventor: Loren A Callahan, 19027 8th NW., Seattle, WA (US) 98177

( * ) Notice: Subject to any disclaimer, the term of this patent is extended or adjusted under 35 U.S.C. 154(b) by 0 days.

(21) Appl. No.: 09/518,208

(22) Filed: Mar. 3, 2000

(51) Int. Cl.[7] ..... A41D 1/04
(52) U.S. Cl. ..... 2/102; 224/155
(58) Field of Search ..... 2/102, 108, 94, 2/69, 85; 224/155, 908; 297/4, 378.14

(56) References Cited

U.S. PATENT DOCUMENTS

| | | | | |
|---|---|---|---|---|
| 3,085,250 | | 4/1963 | Finley . | |
| 4,241,459 | | 12/1980 | Quayle . | |
| 4,669,127 | | 6/1987 | Swanson . | |
| 5,211,321 | | 5/1993 | Rodriguez . | |
| 5,274,851 | | 1/1994 | Simpkins . | |
| 5,361,412 | | 11/1994 | Perry . | |
| 5,440,761 | | 8/1995 | Abrams . | |
| 5,526,535 | * | 6/1996 | Dobrzenski | 2/102 |
| 5,617,582 | | 4/1997 | Burwell . | |
| 5,620,227 | * | 4/1997 | Brune | 297/4 |
| 5,644,794 | | 7/1997 | Hull et al. . | |
| 5,691,028 | * | 11/1997 | Curtis | 428/101 |
| 5,909,802 | | 6/1999 | Puw et al. . | |
| 5,957,349 | * | 9/1999 | Krulik | 224/155 |

* cited by examiner

*Primary Examiner*—John J. Calvert
*Assistant Examiner*—Tejash Patel
(74) *Attorney, Agent, or Firm*—David S. Thompson

(57) ABSTRACT

A photographer's vest with built-in seating and weight bearing structures includes a vest body having front and back panels. The front panel supports a plurality of pockets, including a cargo pocket, utility pocket, lens pocket and side pocket. Adjustable side connectors allow for adjustment of the space between the front and back panels, allowing for use by photographers of different sizes. A shoulder weight-supporting assembly includes neoprene padding under an elastic strap, both of which tend to absorb the shock resulting from movement of the weight carried in the pockets of the vest. A seat is movable between a storage position and an in-use position. In the storage position, the seat is carried against the back panel of the body. In the in-use position, the seat support assembly maintains a connection between the front edge of the seat and the upper portion of the back panel.

3 Claims, 3 Drawing Sheets

PHOTOGRAPHER'S VEST WITH BUILT-IN SEATING AND WEIGHT BEARING STRUCTURES

CROSS-REFERENCES

There are no applications related to this application filed in this or any foreign country.

BACKGROUND

It is well-known that professional photographers must carry with them a large quantity of equipment, including alternate lenses, additional film, batteries and occasionally even spare cameras. This equipment may be carried in a suitcase-like or duffel bag-like container. Alternatively, it is known that a vest may be adapted to support many of the items that a professional photographer requires, such as that disclosed by Norton Rodriguez in U.S. Pat. No. 5,211,321, issued May 18, 1993.

However, while known photographer's vests have generally succeeded in achieving the results for which they were intended, other results and supporting structures have not been envisioned by known photographer's vests. For example, known photographer's vest have not provided a structure which adequately protects the shoulders, neck and back of the photographer from the weight of the materials and supplies stored by the vest. The weight of the supplies which must be carried will, over time, result in muscle and joint soreness, as well as general fatigue and pain in the shoulder, neck and back area. While some attempt to protect the photographer's shoulders have been made, including the use of simple padding, no break-through structure has been disclosed which provides substantial relief for the shoulder, neck and back area.

Similarly, known photographer's vests have not addressed the issue of seating for the photographer. It is an occupational hazard that many photographer's must spend considerable time waiting for the opportunity take important photographs. Similarly, in many situations, the photographer must work from a seated position where no true furniture is available. In this circumstance, lack of support can result in posture difficulties and back pain. In general, because such time spent is rarely spent in pleasantly furnished climate controlled environments, it can be both cold and uncomfortable.

And still further, known photographer's vest have not addressed the issue of providing structural support for the vest. Known photographer's vests are generally floppy in construction, and are of little use in supporting the posture of the photographer, and therefore do nothing to reduce the discomfort that can result from hours of working in improperly furnished environments.

For the foregoing reasons, there is a need for a photographers vest that can better protect the shoulders, neck and back of the photographer from the weight of the materials which must be carried from site to site. The vest should also address the need of the photographer for comfortable and portable seating support. And still further, the photographer's vest should also provide a structural support which integrates with the portable seating to result in better posture and greater comfort.

SUMMARY

The present invention is directed to an apparatus that satisfies the above needs. A novel photographer's vest with built-in seating and improved weight bearing structures is disclosed that is both versatile and comfortable to use.

The photographer's vest with built-in seating and improved weight bearing structures of the present invention provides some or all of the following structures.

(A) A vest body 20 includes front and back panels 21, 22. In a preferred embodiment of the invention, the front panel carries a cargo pocket 40, utility pocket 50, lens pocket 60 and side pocket 70.

(B) Adjustable side connectors 80 allow for adjustment of the distance separating the front and back panels. By regulating this distance, the vest body may be adjusted to fit the torso of most photographers.

(C) A shoulder weight-supporting assembly 90 compensates for changes in the force applied to the shoulders of the photographer due to slight movements of the vest up and down. The shoulder weight-supporting assembly includes a lower layer of neoprene padding and an upper elastic strap. The neoprene padding tends to lessen the downward force resulting from the weight of the items carried in the pockets by compressing slightly when movement of the weight increases the downward force temporarily. The elastic strap similarly tends to lessen the downward force resulting from the weight of the items carried in the pockets by elongating slightly when movement of the weight increases the downward force temporarily.

(D) A seat 100, carried by the back panel, is foldable between a storage position and an in-use position. In the storage position, the seat is carried against the back panel of the body. In the in-use position, a seat support assembly maintains a connection between the front edge of the seat and the upper portion of the back panel.

(E) A stiffening assembly 130, comprising left and right stiffening rods, is carried by the back panel. The stiffening assembly interacts with the seat to provide a chair-like support for the user.

It is therefore a primary advantage of the present invention to provide a novel photographer's vest which has built-in seating with is both comfortable and portable, and which reduces fatigue and discomfort for the user.

Another advantage of the present invention is to provide a photographer's vest which includes structures resulting in sufficient rigidity to compliment the built-in seating, and to therefore improve support and comfort.

A still further principle advantage of the present invention is to provide a photographer's vest which provides a shoulder weight-supporting assembly made of a compound material which covers the shoulders of the user, and reduces fatigue and soreness of the muscles and joints in the shoulder, neck and back area.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figures 1, 2:
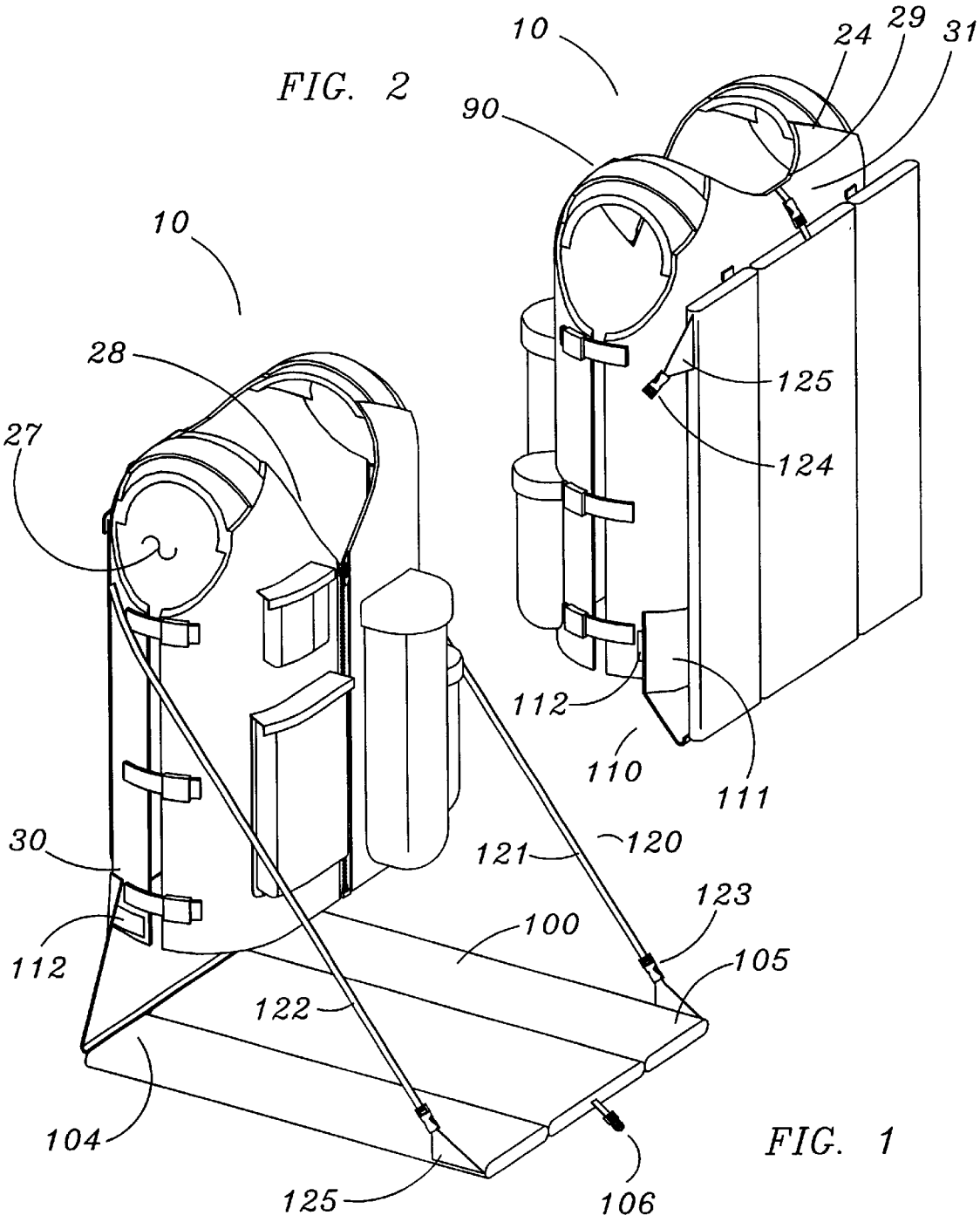
FIG. 1 is a front and side perspective view of a version of the photographer's vest of the invention having the seat in the in-use position.
FIG. 2 is a side and rear perspective view of the photographer's vest of FIG. 1, having the seat in the storage position.

Referring in generally to FIGS. 1 and 2, a photographer's vest 10 with built-in seating and weight bearing structures constructed in accordance with the principles of the invention is seen. A vest body 20 includes front and back panels 21, 22. The front panel 21 supports a plurality of pockets, including a cargo pocket 40, utility pocket 50, lens pocket 60 and side pocket 70. Adjustable side connectors 80 allow for adjustment of the space between the front and back panels, allowing the overall size of the vest to be altered in a one-size-fits-all manner. A shoulder weight-supporting assembly 90 includes neoprene padding under an elastic strap, both of which tend to absorb the shock resulting from movement of the weight carried in the pockets of the vest. A seat 100 is movable between a storage position and an in-use position. In the storage position, the seat is carried against the back panel of the body. In the in-use position, the seat support assembly maintains a connection between the front edge of the seat and the upper portion of the back panel.

A preferred version of the photographer's vest includes a body 20 having separate front and back panels 21, 22. By regulating the space between the panels on the sides of the vest, the size of the vest may be adjusted to accommodate photographers of different sizes. The front panel 21 is divided to include left and right sides 33, 34. The left and right sides may be releasably connected by a front fastener, such as the zipper 32 used in the preferred embodiment, or alternatively, by snaps, buttons, VELCRO® or other fasteners. A front V-neck 28 and rear crew neck 29 are preferred. Sleeveless arm openings 27 add to mobility and prevent over-heating.

Figure 3:
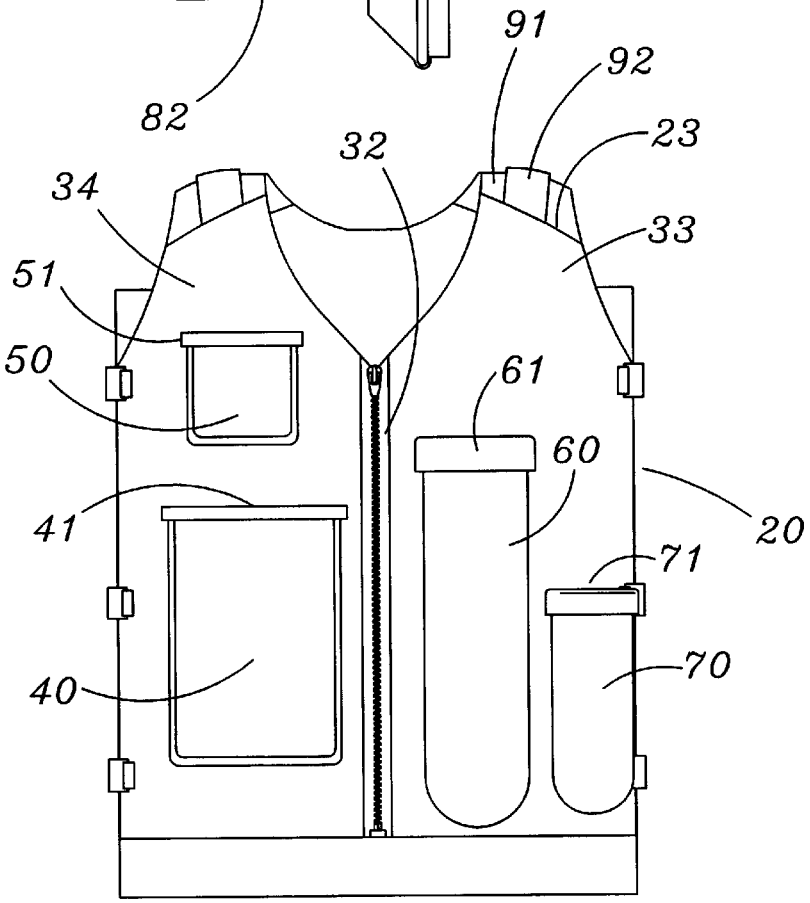
FIG. 3 is a front orthographic view of the photographer's vest of FIG. 1.
Figure 6:
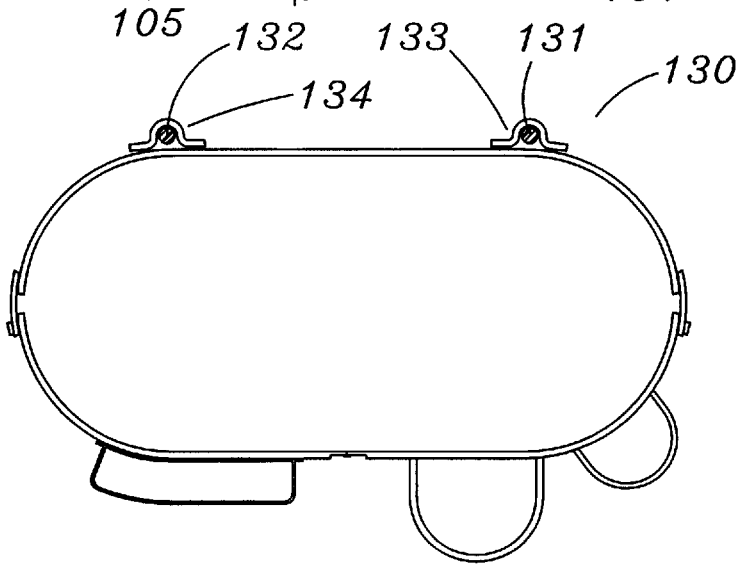
FIG. 6 is a cross-sectional view of the photographer's vest of FIG. 5, taken along the 6—6 lines of that figure.

As seen particularly in FIGS. 1, 3 and 6, in a preferred embodiment of the invention, the front panel carries a cargo pocket 40, utility pocket 50, lens pocket 60 and side pocket 70. The cargo pocket 40, having a flap 41, is carried on the lower right side 33 of the front panel 21. The cargo pocket is typically large enough for containing a camera body, film, extra batteries or other gear.

A utility pocket 50, having flap 51, is carried on an upper portion of the right side of the front panel, above the cargo pocket. The utility pocket is smaller than the cargo pocket, and is therefore better suited for carrying film, batteries, and other smaller items.

A lens pocket 60, having flap 61, is carried on an inside portion of the left side of the front panel. The lens pocket is sized to contain an elongated, generally cylindrical lens, such the type used in telephoto applications.

A side pocket 70, having flap 71, is carried by the outside portion of the left side of the front panel, adjacent to the lens pocket. The side pocket is sized for carrying a smaller lens or other equipment, as desired.

Adjustable side connectors 80 allow for adjustment of the distance separating the front and back panels. By regulating this distance, the vest body may be adjusted to fit the torso of most photographers. In a preferred embodiment, the side connectors include webbing straps 81 and associated adjustable fasteners 82, and are attached to the side edges 25, 26 of the front and rear panels. By adjusting the length of the webbing strap to pass through the fastener, the space between the front and back panels may be regulated.

A shoulder weight-supporting assembly tends to damp changes in the force applied to the shoulders of the photographer due to slight movements of the vest up and down resulting from the normal movements of the photographer. A shoulder weight-supporting assembly 90 includes a lower layer of neoprene padding 91 and an upper layer of elastic strap 92. Due to movement of the photographer, particularly during rapid walking or short sprints required to obtain a better position for taking a photograph, the downward force of the material carried in the pockets tends to vary. This is because the vest tends to move up and down slightly in response to the photographer's movement. When the vest moves upwardly, there is a corresponding increase in the force applied to the photographer's shoulders. When the vest moves down, there is a similar decrease. Smoothing out these forces results in less muscle and joint soreness.

The neoprene padding 91 tends to lessen the downward force resulting from movement of the vest upwardly. This absorption of force is accomplished by slight compression and elongation of the neoprene. The neoprene is resilient, however, and returns to its original dimensions when the vest is stationary or when the vest moves downward slightly. The neoprene padding is attached to an upper edge 23 of the front panel and an upper edge 24 of the rear panel.

Similarly, the elastic strap 92 similarly tends to lessen the downward force resulting from movement of the vest upwardly. This absorption of force is accomplished by elongation of the elastic strap. The elastic is resilient, however, and contracts when the vest is stationary or when the vest moves downward slightly.

A seat 100, carried by the back panel 22, is foldable between a storage position and an in-use position. In the storage position seen in FIGS. 2 and 4, the seat is carried against the back panel of the body. In the in-use position seen in FIGS. 1 and 5, the seat is attached to the lower edge of the back panel.

Figure 7:
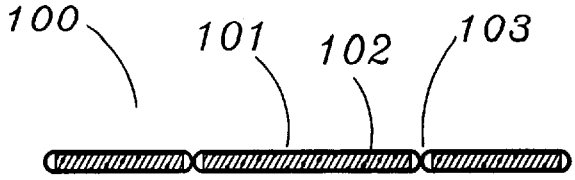
FIG. 7 is a cross-sectional view of the seat, taken along the 7—7 lines of FIG. 5.

As seen in the cross-sectional view of FIG. 7, a preferred seat includes a cover 101 with internal padding 102. Stitching 103 may be used to stabilize the padding and to prevent it from moving within the cover.

Figure 4:
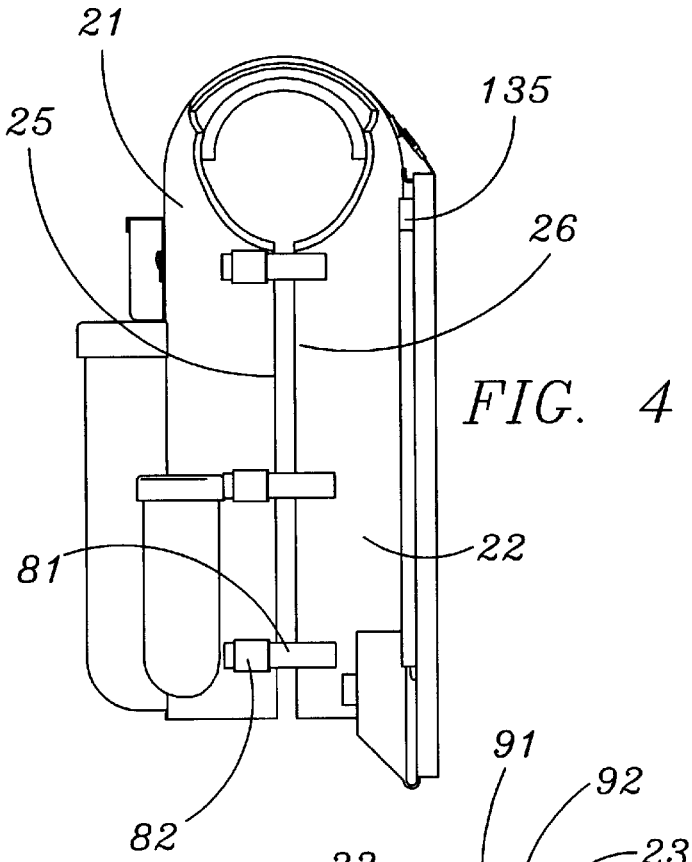
FIG. 4 is a side orthographic view of a version of the photographer's vest having left and right stiffening rods carried within left and right stiffening rod pockets.

As seen in FIGS. 1, 2 and 4, a fastener, such as the snap 106 carried on the front edge 105 of the cover, is used to fasten the cover into the storage position seen in FIGS. 2 and 4. A corresponding fastener, such as the snap 107 carried on an upper portion of the back panel 22, allows the photographer to secure the seat into the storage position seen in FIG. 2.

Figure 5:
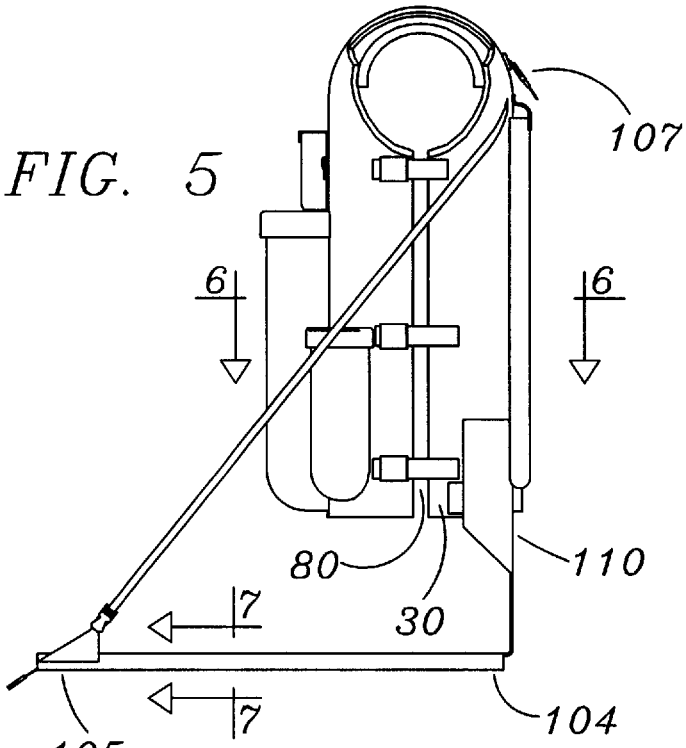
FIG. 5 is a side orthographic view of the photographer's vest of FIG. 4, having the seat in the in-use position.

As seen in FIGS. 1, 2 and 5, the rear edge 104 of the seat carries a seat attachment fastener 110. The seat attachment fastener holds the seat to a lower portion of the back panel of the body when the seat is in both the in-use and storage positions.

In a preferred embodiment, the seat attachment fastener is made of VELCRO® or a similar hook and loop fastener. As seen in FIGS. 1, 2, 4 and 5, a relatively large panel of female VELCRO® 111 is carried by the rear edge 104 of the seat. A relatively narrow strip of male VELCRO®) 112 is carried by a lower portion 30 of the back panel of the vest body. Due to the size difference between the fasteners 111, 112, the distance between the rear edge 104 of the seat and the lower edge of the back panel can be adjusted. In general, the longer the torso of the photographer, the greater the distance required between the shoulder weight-supporting assembly 90 and the seat 100. Therefore, the location on the relatively larger fastener 111 which is adhered to the relatively smaller fastener 112 should be selected to result in the correct distance between seat and shoulder assembly.

As seen particularly in FIGS. 1 and 5, a seat support assembly 120 provides support between the seat 100 and the vest body 20. As seen in FIG. 1, the seat support assembly allows the photographer to lean back when the seat is in the in-use position. The weight of the photographer keeps the seat 100 in place. The seat support assembly provides a counter-balancing force in the forward direction, resisting the backward force as the photographer leans back, thereby providing chair-like support.

In a preferred embodiment, the seat support assembly includes left and right straps 121, 122. An upper end of each strap connects to an upper portion 31 on the left and right sides, respectively, of the back panel 22. A lower end of each strap carries a fastener, such as snap 123, which is releasably attachable to a corresponding fastener 124 carried by a location adjacent to left and right ends of the front edge 105. In the embodiment of the invention seen in FIG. 1, a fabric base 125 carries the fastener 124, and provides a better connection between the fastener and the seat.

A stiffening assembly 130 carried by the back panel 22 results in more rigid and chair-like support for the photographer when using the seat in the in-use position of FIG. 1. A preferred stiffening assembly includes left and right stiffening rods 131, 132, is carried by stiffening rod pockets 133, 134 carried by the back panel 22. Each stiffening rod is made of material such as plastic having the ability to bend somewhat and yet resiliently return to the original shape. Pocket flaps 135 may be used to prevent a stiffening rod from protruding from the pocket within which it is carried.

To use the photographers vest 10, the photographer may decide to install or remove the rods 131, 132 from the pockets 133, 134 of the stiffening assembly 130, as desired. The seat attachment fastener 110 is adjusted, so that the distance from the seat cover 101 to the neoprene padding 91 of the shoulder assembly is appropriate for the photographer. The photographer then puts the vest on. The adjustable side connectors 80 may be adjusted, as needed, to allow a comfortable fit. The zipper 32 is then fastened. The pockets 40, 50, 60 and 70 may then be filled and the flaps sealed.

When use of the seat 100 is desirable, the fastener 106 on the seat is released from the fastener 107 on the upper portion 31 of the back panel 22. The seat support assembly 120 may then be installed, if desired, by attachment of snaps 123, 124.

The previously described versions of the present invention have many advantages, including a primary advantage of providing a novel photographer's vest which has built-in seating with is both comfortable and portable, and which reduces fatigue and discomfort for the user.

Another advantage of the present invention is to provide a photographer's vest which includes structures resulting in sufficient rigidity to compliment the built-in seating, and to therefore improve support and comfort.

A still further principle advantage of the present invention is to provide a photographer's vest which provides a shoulder weight-supporting assembly made of a compound material which covers the shoulders of the user, and reduces fatigue and soreness of the muscles and joints in the shoulder, neck and back area.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while the pockets consistent with a preferred embodiment have been disclosed, other alternative pocket arrangements could be substituted. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A photographer's vest, comprising:

(A) a vest body comprising front and back panels;

(B) adjustable side connector means for adjustment of the distance separating the front and back panels;

(C) a shoulder weight-supporting assembly, carried between the front and back panels, comprising a lower layer of neoprene padding and an upper layer of elastic; and (D) a seat, removably carried by a fastener attached to the back panel, foldable between a storage position and an in-use position.

2. The photographer's vest of claim 1, additionally comprising:

(A) a stiffening assembly, comprising left and right stiffening rods, carried by stiffening rod pockets carried by the back panel.

3. A photographer's vest, comprising:

(A) a vest body comprising a front panel and a back panel, wherein the front panel supports a cargo pocket, utility pocket, lens pocket and side pocket;

(B) adjustable side connector means for adjustment of the distance separating the front and back panels, comprising at least one webbing strap attached to the back panel and at least one adjustable fastener attached to the front panel;

(C) a shoulder weight-supporting assembly, carried between the front and back panels, comprising a lower layer of neoprene padding and an upper layer of elastic;

(D) a seat, carried by the back panel, foldable between a storage position and an in-use position, wherein in the storage position the seat is carried against the back panel of the body, and wherein in the in-use position a seat support assembly maintains a connection between the front edge of the seat and the upper portion of the back panel; and (E) a stiffening assembly, comprising left and right stiffening rods, carried by the back panel.

* * * * *